US005520392A

United States Patent [19]

Foresi et al.

[11] Patent Number: 5,520,392

[45] Date of Patent: May 28, 1996

[54] GOLF TRAINING DEVICE FOR TEACHING PENDULUM-TYPE PUTTING SWING

[76] Inventors: Anthony Foresi, 9717 Manor, Allen Park, Mich. 48101; William P. Conley, 2780 Packard Rd., Ypsilanti, Mich. 48197

[21] Appl. No.: 406,009

[22] Filed: Mar. 16, 1995

[51] Int. Cl.[6] ..... A63B 69/36

[52] U.S. Cl. ..... 473/227; 473/276

[58] Field of Search ..... 273/191 R, 194 R, 273/81.2, 81.3, 192, 186.2

[56] References Cited

U.S. PATENT DOCUMENTS

| | | | |
|---|---|---|---|
| 3,963,244 | 6/1976 | Mierzejewski | 273/162 R |
| 4,154,054 | 3/1979 | Stewart | 273/186.2 |
| 4,399,994 | 8/1983 | Hourihan | 273/191 R |
| 4,595,204 | 6/1986 | Patterson | 273/186.2 |
| 4,880,240 | 11/1989 | Lewis | 273/188 R |
| 5,150,901 | 9/1992 | Stawicki | 273/191 R X |
| 5,156,401 | 10/1992 | Hodgkiss | 273/186.2 |
| 5,303,926 | 4/1994 | Owens et al. | 273/186.1 |
| 5,308,071 | 5/1994 | Lewis | 273/187.2 |
| 5,328,185 | 7/1994 | Finnigan et al. | 273/186.2 |
| 5,342,055 | 8/1994 | Diley | 273/187.2 |

*Primary Examiner*—George J. Marlo

*Attorney, Agent, or Firm*—Gifford, Krass, Groh, Sprinkle, Patmore, Anderson & Citkowski

[57] ABSTRACT

A lightweight, convenient training device includes a rigid, elongated member having first and second ends, and a clamping mechanism used to adjustably then rigidly secure the member at its first end to a golf club, including a putter, preferably to the shaft at a point just below the hand grip. So positioned, the second end of the member may then be comfortably positioned in the user's armpit to stabilize the swing, with the adjustability of the clamping mechanism ensuring compliance with various grip styles and lie angles. In the preferred embodiment, the elongated member includes a bend near the first end to prevent contact with the user's hands, and the clamping mechanism includes means for adjusting the elongated member along two degrees of freedom with respect to the golf club shaft. The member may be folded down onto the club and in substantial alignment therewith to ease transportation, and a stop may be optionally provided so that the user may more quickly assume a desired orientation of the member relative to the club for use.

7 Claims, 4 Drawing Sheets

PRIOR-ART

GOLF TRAINING DEVICE FOR TEACHING PENDULUM-TYPE PUTTING SWING

FIELD OF THE INVENTION

The present invention relates generally to golf training devices, and, in particular, to a device which may be removably secured to a putter to teach and promote a pendulum-style swing whether for training or play.

BACKGROUND OF THE INVENTION

A wide variety of training devices are available to the golf enthusiast. Those not suitable for putting include U.S. Pat. No. 4,145,054, which comprises a rod attached to a golf club shaft which contacts the forearms the golfer during an improperly executed swing, thus advising of the error U.S. Pat. No. 4,595,204 discloses an elongated extension removably attached no the handle of the club. As the golfer performs a backstroke, forward stroke and follow-through simulating the striking of a ball, the extension indicates if the stroke is "correct." U.S. Pat. No. 5,150,901 includes a harness assembly attachable to the upper portion of a person's body and an elongated tubular golf swing guiding member coupled to the harness and attached to the handle of the club, which permits a golfer to achieve a proper swing by avoiding undesired bending of the front elbow. A multi-use golf training device is described in U.S. Pat. No. 5,303,926, which includes a weighted base and an upstanding flute guidepost with a positioning bar. By setting the positioning bar in one of a plurality of positions relative to the user, proper body positions and swing motions can be reinforced, thus improving a user's stance and wring during actual play.

With specific regard to putting, many experts now agree that the ideal stroke is a "pendulum" swing initiated at the shoulders with the wrists locked about the handle of the club. Many the training devices accordingly operate to enforce this pendulum movement. For example, U.S. Pat. No. 3,963,244 discloses a specialized putter consisting of two shafts in spaced-apart parallel relation and pivotally attached, one having a lower ground-engaging member and the other having a putter head, enabling the user to hold one shaft steady while pivoting the other in a pendulum motion. This is not a training device, however, but rather, a specialized putter which operates at 90 degrees conventional clubs, that is, the stroke is forward and away from the golfer as opposed to being from side to side.

More recent putter training and practice devices include U.S. Pat. No. 4,880,240, which provides a specially constructed putter in a stroke guide worn at the user's waist wherein a pivot point is created, rather than at the shoulders. U.S. Pat. No. 5,308,071 includes an extension attachable to the putter grip and a guide attachable to the waist of a golfer having a narrow horizontal slot to receive a tab on the extension. In one embodiment, the pivot point for pendulum action may be moved up from the waist to the chest area. U.S. Pat. Nos. 5,156,401 and 5,328,185 also teach elongated putters which extend roughly from the chest area down to the golf club head. In U.S. Pat. No. 5,156,401, the upper end includes a cross piece which abuts the user's chest and has end portions which extend under the user's arms to promote and maintain good stance by maintaining a constant triangular shape defined by the user's shoulders and hands. In U.S. Pat. No. 5,328,185, one hand is used to grip the upper end of an elongated putter in the shaft area, while the other hand grips the club midway, using either a small protruding extension or a U-shaped handle. U.S. Pat. No. 5,342,055 includes an elongated rod having a neck-engaging mender and a quick release connector for attaching the rod to the head of the putter. The length of the rod is adjustable and defines the radius of the arc of motion of the club relative to the golfer so that the swing is constrained in a precisely defined path to teach the golfer a repetitive stroke.

All of the devices just described present drawbacks, however, either concerning the manner in which they are used, or their design complicates transport. More specifically, if the training aid is very long and not subject to dismantling, it is awkward to carry, especially in a conventional golf bag. Also, if the device requires a modified club, it may force the user's hands into an unnatural or uncomfortable position. If the grip departs in even a minor way from that of a standard club, many golfers will be uncomfortable with the arrangement.

Another difficulty with a dedicated training device is that the golfer may be forced to use a club exclusively for practice, and a totally different style club exclusively for play. With specific regard to putters, golfers are very finicky about their favorite club, and forcing the enthusiast to practice with a different style device with an unfamiliar grip presents a severe shortcoming. Thus there remains a need for a training device which teaches the pendulum swing yet enables the golfer's wrist and hand to be effectively locked during the stroke. At the same time, it is desirable to provide these benefits without limiting the golfer's choice of putting style or grip technique. An easily portable means of providing this training would result in an even more advantageous configuration.

SUMMARY OF THE INVENTION

The present invention provides a lightweight, convenient training device adapted for attachment to a a putter to teach or promote a pendulum-style swing. Broadly, the invention includes a rigid, elongated member having first and second ends, and a clamping mechanism used to adjustably but rigidly secure the member at its first end to a putter preferably to the shaft at a point just below the hand grip of the club. So positioned, the second end of the member may then be comfortably positioned in the user's armpit to stabilize the swing, with the adjustability of the clamping mechanism ensuring compliance with various grip styles and lie angles. In the preferred embodiment, the elongated member includes a bend near the first end to prevent contact with the user's hands.

Also in the preferred embodiment, the clamping mechanism includes means for adjusting the elongated member along two degrees of freedom with respect to the putter shaft prior to rigidly securing the first end of the member thereto, and further includes a stop limiting at least one degree of freedom to that the user may more quickly assume a desired orientation of the member relative to the club. In one embodiment, one degree of freedom involves twisting of the clamping mechanism about the axis of the golf club shaft, with the second degree of freedom involving rotation of the member at least proximate to its first end in a plane parallel the golf club shaft.

The clamping mechanism accordingly preferably includes a first, portion which adjustably engages with the first end of the elongated member, and a second portion which adjustably secures to the golf club shaft. In one embodiment, the first portion of the clamping mechanism includes a pair of outwardly extending lugs and means to compress the first end of the member between the lugs. The second portion of the clamping mechanism preferably includes a pair of opposing, at least partially cylindrical gripping surfaces and means to compress the two surfaces against the putter shaft. In the preferred embodiment manual adjustment means are provided to simultaneously secure the first end of the elongated member and the second portion of the clamping mechanism to the golf club shaft. In this case the clamping mechanism be in the form of two split halves, with a compressions type fastener extending therethrough to urge the two halves together with the first end of the member and the golf club shaft secured therebetween. In an alternative embodiment a first manual adjustment means may be used to independently engage with the first end of the elongated member, and a second manual adjustment means may be used to independently secure the second portion of the clamping mechanism to the golf club shaft.

DETAILED DESCRIPTION OF THE PREFERRED EMBODIMENTS

Figure 1:
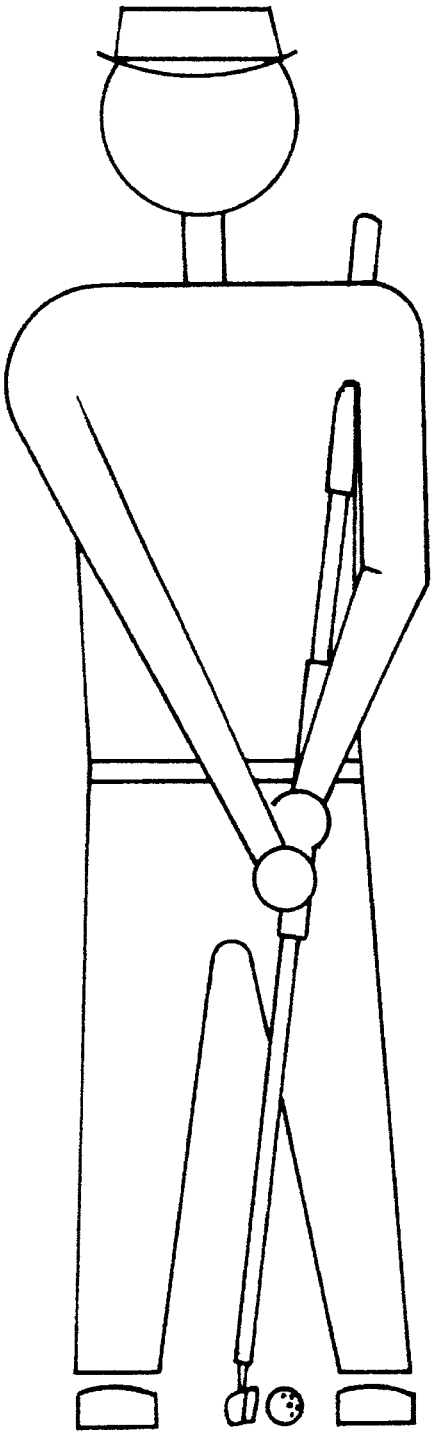
FIG. 1, is simplified, frontal view of a golfer using a putter having an elongated shaft for training purposes.

As mentioned in tile Background of the Invention, many golf professionals feel the ideal putting stroke is a "pendulum" swing initiated at tile shoulders with wrists and hands locked about the club grip. Many training aids have thus been introduced to promote this pendulum swing and to discourage bending of the wrists and hands during this stroke. In addition to the devices described in the patents cited herein, a recently introduced training aid called the "pit" putter is shown in use in FIGS. 1 and 2. The pit putter is designed to lock the wrists and hands by means of an extra long putter shaft, having an upper end which is nestled under the armpit of the user, as shown. Thus, during the swing, all movement must originate from the shoulders and the wrists and hands cannot move to complicate the putting motion.

Figure 2:
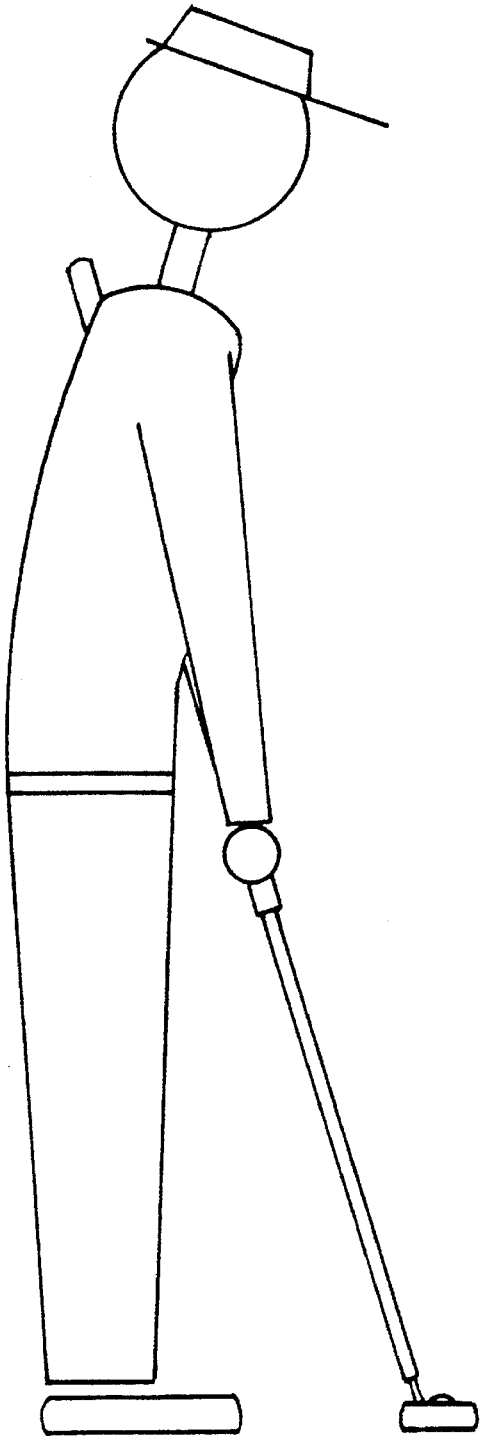
FIG. 2 is a side view of the golfer and device of FIG. 1.

FIG. 2 presents a side view of this pit putter in use. Although such a device is effective for teaching a pendulum swing, the club is very long and awkward to carry. Also, a closer inspection of FIG. 1 reveals that the grip associated with this club forces the hands into an unnatural position, such that for a right-handed golfer, for example, the right arm is necessarily straighter than the left and the hands must be moved upward toward the left side of the golfer's body. For many golfers, this is an uncomfortable and unacceptable grip position, which cannot be readily transferred for subsequent use with a standard putter, since the associated grip styles are so different.

Figure 3:
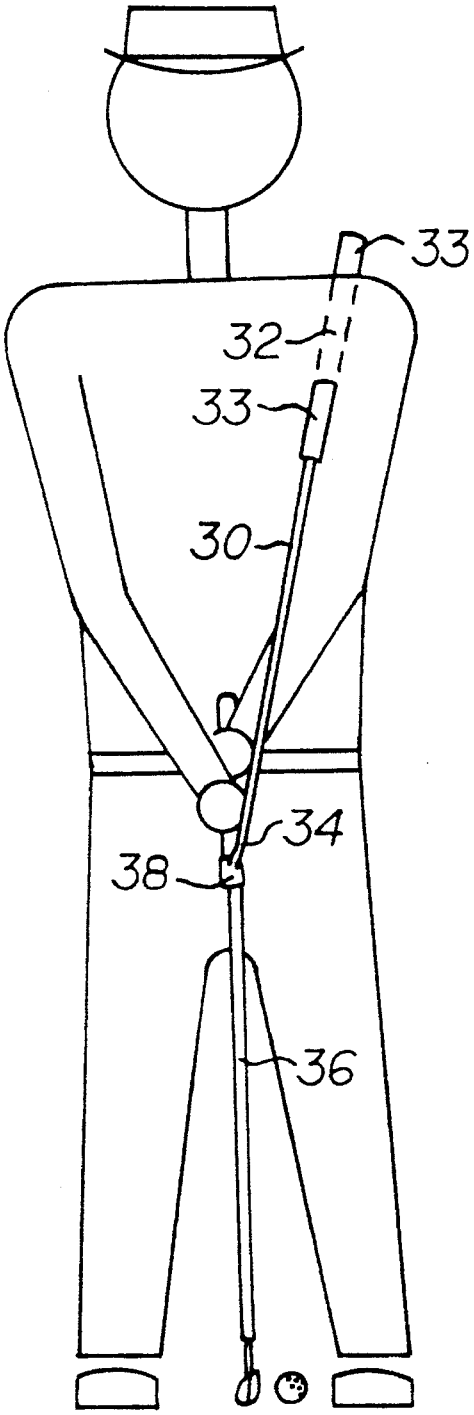
FIG. 3 is a front view drawing of an improved attachment according to the present invention which may be removably secured to a standard putter.

FIG. 3 is a front-view drawing of an improved golf club attachment according to the invention. Broadly, the device includes an elongated member 30 having a proximal end 32 adapted for positioning under one or the other of the use's armpits, and a distal end 34 which is removably secured to a standard, unmodified putter 36 using a clamping mechanism 38 which attaches the member 30 to the club 36 preferably at a point just below the grip area, as shown. The attachment is fully adjustable to accommodate the golfer's preferred grip style and lie angle of the club and, in addition, is lightweight and readily detachable for ease of transport. The attachment thus provides-all of the benefits of the prior art while overcoming the drawbacks mentioned above. It promotes a pendulum swing at the shoulders, but provides true isolation or locking of the wrists and hands in a preferred, natural configuration.

In terms of construction, the elongated member 30 may either be in the form of a solid rod, or, preferably, a lightweight hollow rigid tube or shaft. The proximal end 32 preferably includes a grip covering which serves the dual purposes of enhancing comfort under the arm of the user during use, and also, should the golfer place the device in a golf bag during non-use, it may appear to be just another club and therefore visually blend with the golfer's other accessories.

Note in the view of FIG. 3 that even if the golfer prefers a substantially vertical pre-swing position, the clamp mechanism 38 allows the elongated mender 30 to extend upwardly and away from the shaft 36 of the club at an angle which allows the proximal end 32 to be nestled under either arm of the user with the club oriented straight down when viewed frontally.

Figure 4:
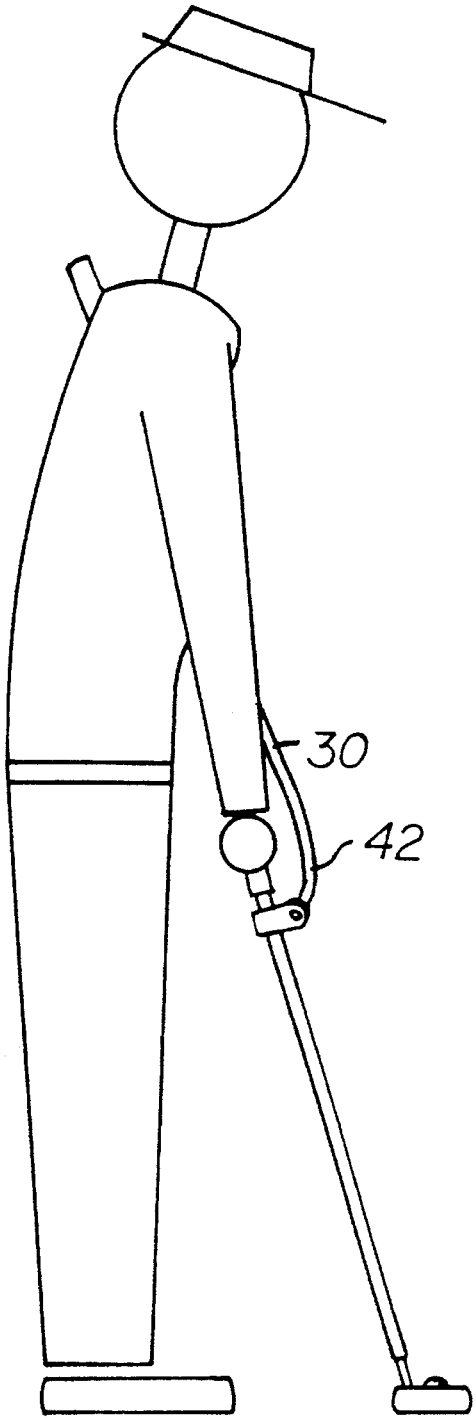
FIG. 4 is a side view of the golfer of FIG. 3.

FIG. 4 is a side view of the invention in use, which illustrates that, in the preferred embodiment, the elongated members 30 includes a bend in the vicinity of 42 so that, when clamped below the handgrip, the member 30 angles up and over the hands, thus providing the proper angle from the putter shaft, to the golfer's armpit, and also provides clearance for the golfer's hands, as shown. Apart from this bend, in the preferred embodiment, the remainder of the elongated member 30 is more or less straight, though other bends in the member 30, including compounds bends in three dimensions are not precluded by the invention, for example, for the purposes of design or comfort, so long as the member 30 is substantially rigid and the clamping mechanism, which will be subsequently described in further detail, rigidly attaches the member 30 to the putting shaft as shown.

Figure 5:
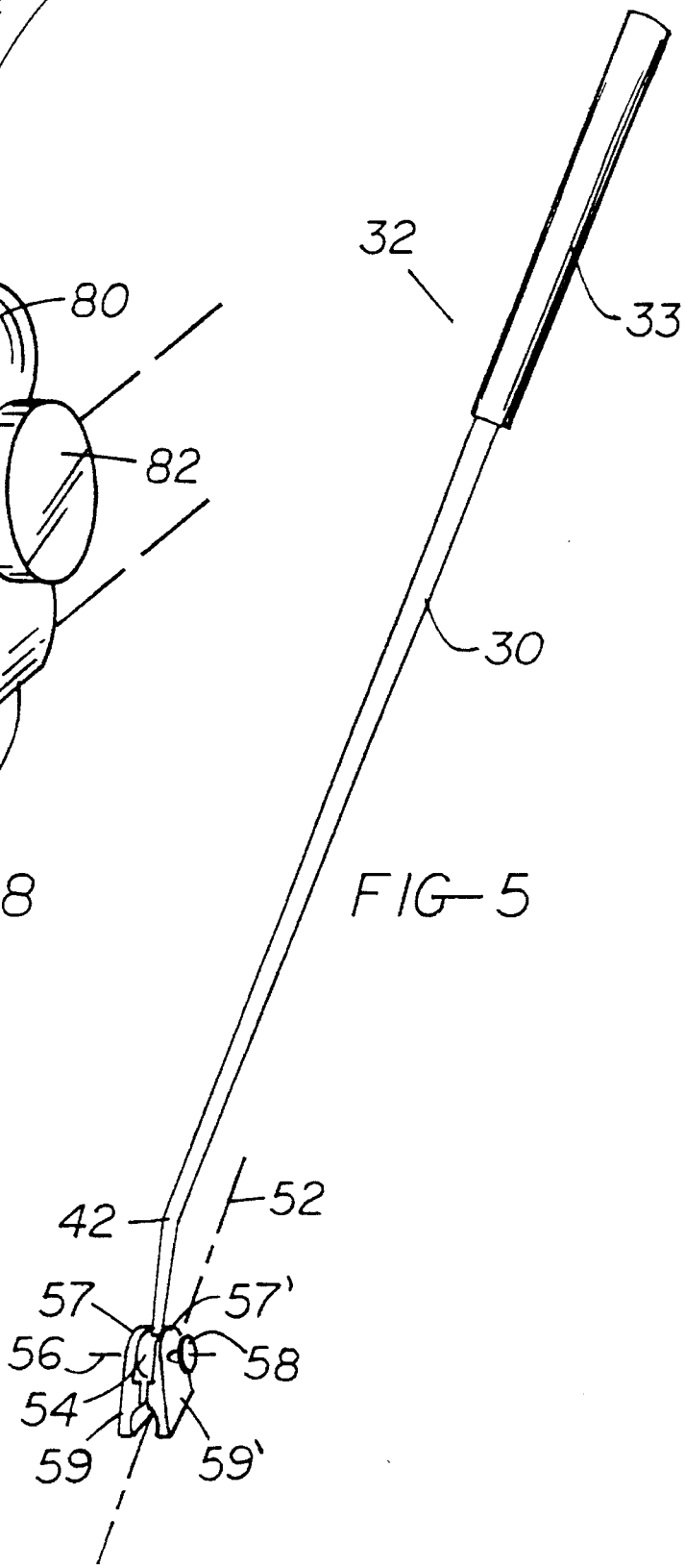
FIG. 5 is an oblique drawing of a preferred embodiment of the invention disconnected from the club.

FIG. 5 is an oblique drawing of a preferred embodiment of the invention removed from the golf club shaft axis, shown with broken line 52. In this preferred embodiment, the distal end of the member 30 past the bend 42 terminates in an element 54 having a bore formed therethrough, thus facilitating pivoting rotation about axis 56. Two lug-like tabs 57 and 57' form part of the clamp mechanism, and a manually adjustable knob 58 is used to compress these lugs 57 and 57' against the element 54, thus resulting in an overall rigid configuration involving the club and member 30. In the preferred embodiment, the lugs 57 and 57' are each associated with an independent half off the clamping mechanism, whereby, when the knob 58 is tightened, a second set of grips 59 and 59' simultaneously tighten onto the shaft of the putter. However, separate adjustments to rigidly secure the member 30 and the golf club shaft are not: precluded by the invention. That is, two adjustment knobs may be provided to facilitate independent compression clamping onto the putter shsft apart from that provided for fixing the motion off the member 30 with respect to the clamp and club shaft. Additionally, although, in the preferred embodimet, the member 30 is adapted for rotation in a single plane, it should be recognized that more degrees of freedom are in keeping with the invention, so long as the member 30 may be locked into place. For example, the use of a ball and-socket joint in lieu of a rotational type fixture may alternatively be used.

Figure 6:
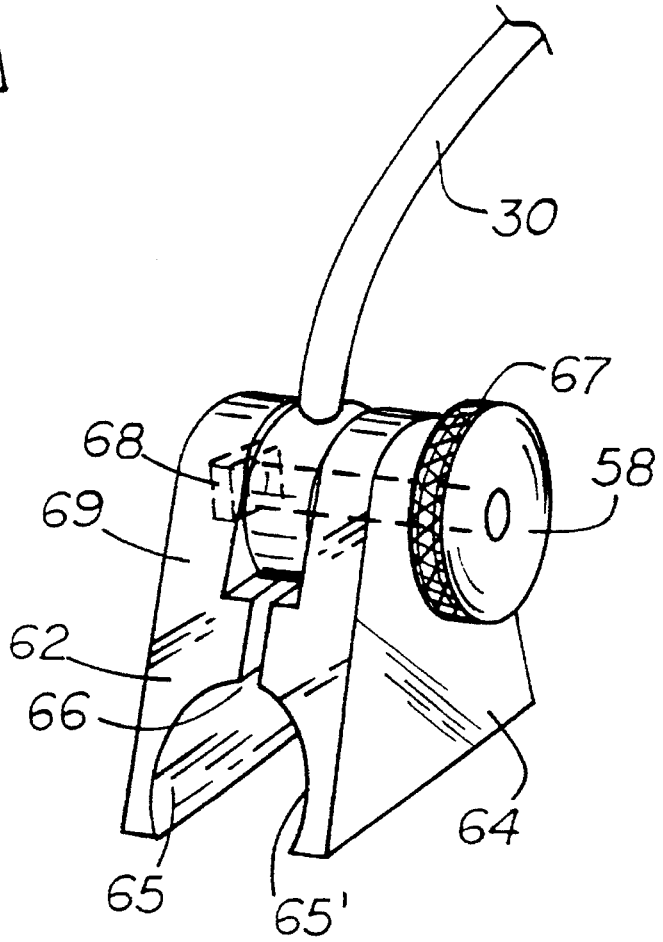
FIG. 6 is a detailed view of a preferred clamp assembly associated with the invention.

FIG. 6 provides a closer view of the preferred clamp mechanism and better illustrate how the preferred clamp is formed as two halves 62 and 64, having a split 66 formed therebetween. The inside surfaces 65 and 65' associated with clamping the club shaft are preferably at least partially cylindrical to ensure positive attachment. All of the friction engaging surfaces, such as the inner walls of the lugs which engage the element 54, the outwardly facing surfaces of the element 54, and the surfaces 65 and 65' may be textured on a selective basis to increase friction and gripping power. FIG. 6 also shows that the manual adjustment knob 58 may include an outward knurled surface 67 to enhance a user's grip for tightening purposes. The knob 58 preferably terminates in a non-circular end 68 recessed into a cavity formed in the lug 69, thus preventing rotation of that end while the adjustment knob 58 is tightened. Various other means are alternatively available for accomplishing this function, including non-circular shapes other than square, as shown, as well as permanent welding of the threaded shaft to one of the lugs, and so forth.

Figure 7:
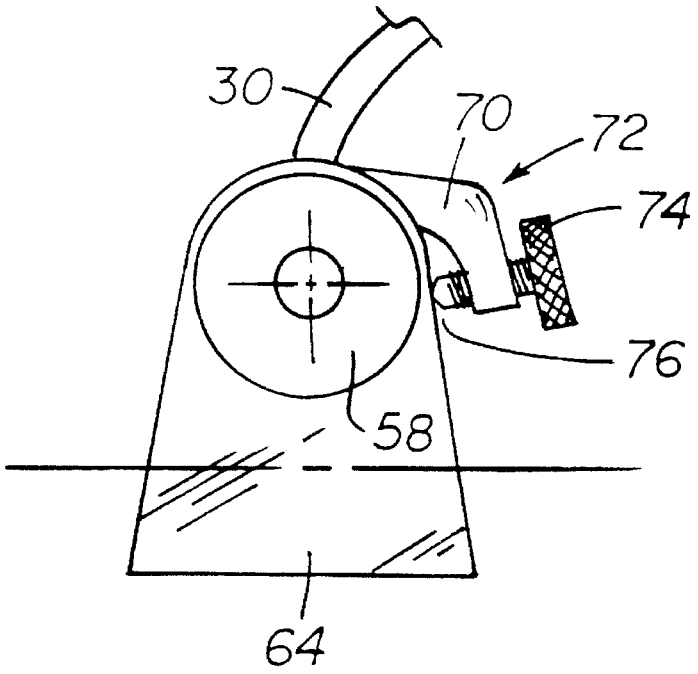
FIG. 7 is a side view drawing of an optional stop which limits the rotation with respect to the clamp and golf club shaft to more readily return to a preferred orientation.

FIG. 7 shows an alternative embodiment of the invention incorporating an optional stop consisting of an arm 70 rigidly attached to the member 30 or to the element 54. In the preferred embodiment, this arm 70 is bent in the vicinity of 72 and threaded to accept a second manually adjustable element 74 having an end 76 which engages with some portion of the clamp assembly making direct contact to the golf club shaft. The use of this optional stop provides a preset point for the rotation of the elongated mender 30, thus allowing a particular user to rotate the member 30 outward quickly to a desired angle with respect to the golf club shaft, as determined by the setting of the adjustment knob 74. Particularly with the addition of this positive stop device, it is convenient to simply fold the attachment according to the invention against the golf club shaft for transport instead of removing it entirely.

Figure 8:
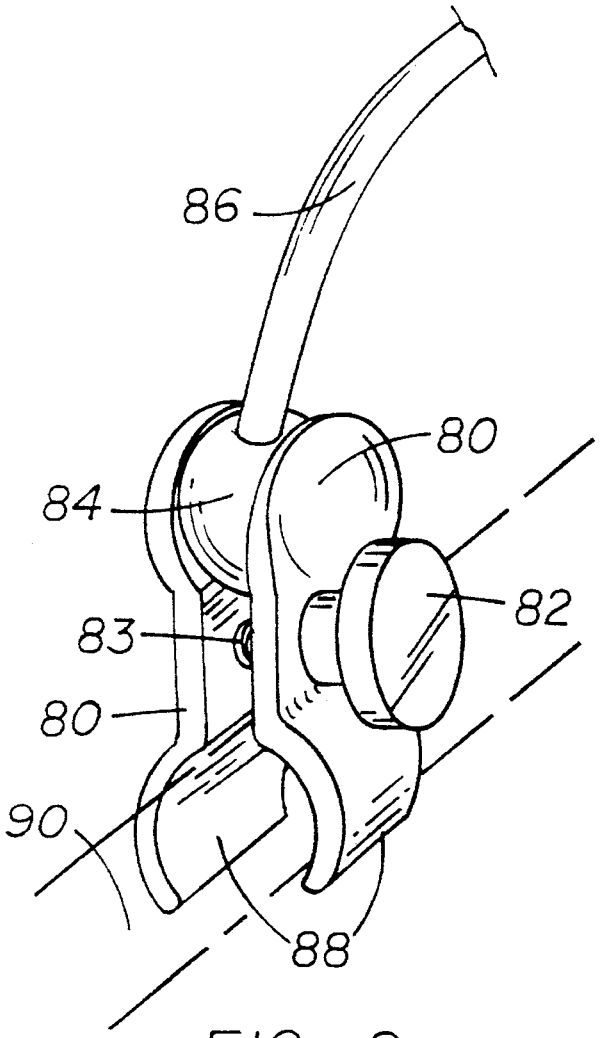
FIG. 8 is an oblique representation of an alternative embodiment of the invention wherein an elongated member connects to the clamping mechanism through a ball-and-socket type of joint, and wherein the clamping mechanism, in the form of two half members, is compressed with a manual fastener at a point between the ball-and-socket joint and surfaces which grip the golf club shaft.

FIG. 8 is an oblique representation of an alternative embodiment of the invention wherein, instead of a rotational attachment between the elongated member and the clamping mechanism, a ball-and-socket type of connection is instead used. Although such a connection may not be as stable over extended periods of time, such an alternative system does provide further degrees of freedom between the clamp and the elongated member, which may be advantageous for different players, for example during the same game, to use the invention without altering the status of the clamping mechanism with respect to the golf club shaft. The clamping mechanism consists of two side members 80, comprising an upper portion which engages with a ball 84 formed on the distal end one the elongated member 86, and a second portion having cylindrically shaped grippers 88 which frictionally engage with the golf club shaft 90, depicted with broken lines. A knob 82 connected to a threaded shaft 83, the shaft extending through both half members comprising the clamping assembly, is used to compress both halves simultaneously, thereby locking the ball-and-socket joint into a desired orientation, while, simultaneously, gripping the shaft of the club. It should be recognized that aspects of the preferred enbodiments described earlier may be interchanged with those of this alternative configuration, yet remain keeping within the bounds of the invention. For example, location of the manual adjustment knob 82 between the first and second portions of the clamping mechanism may alternatively be used in any of the embodiments depicted herein, and, likewise, a mechanical stop may be incorporated into the alternative embodiment of FIG. 8. Various other alternative combinations are also possible, Thus, the attachment described herein offers an improved putt training device which provides all of the benefits of the prior art devices while eliminating their shortcomings. The device according to the invention teaches a pendulum swing using a conventional putter and avoids the user's hands for any preferred grip style. The device may be detached for easy transport, and, when mounted onto the club shaft, allows a first, twisting degree of freedom about the club shaft and at least a second, rotational or pivoting degree of freedom with respect thereto, thus accommodating all grip styles and lie angles. In an alternative embodiment, an adjustable stop is disclosed, whereby the user may readily fold the attachment down onto the club proper and return it to a desired orientation without removing

Having thus described my invention, I claim:

1. A golf training device adapted for attachment to a putter for assisting a golfer using the device to adopt a pendulum-like while putting a golf ball, such a swing being characterized in that the face of the putter is at all times perpendicular to the line of travel during a smooth and consistent putting motion the device consisting of a rigid, elongated member having proximal and distal ends, the distal end including a bent section terminating in a mechanism for attaching that end to the shaft of the putter just below the handgrip, resulting in an entirely rigid system therebetween, the member when so attached extending upwardly and away from the putter at an angle with respect to the shaft, the bent section allowing the member to curve outwardly with respect to the golfer as well so as not to interfere with the golfer's hands, and the curve in the bent section and the angle of the member with respect to the shaft of the putter when rigidly attached thereto being such that the proximal end may be comfortably nestled under the golfer's armpit throughout the pendulum-like swing.

2. The golf training device of claim 1, the mechanism for attaching the distal end of the elongated member to the shaft of the putter further comprising a clamping assembly having a first end attached to the distal end of the member through a locking joint and a second end with a locking clamp configured for rigid engagement with the putter shaft.

3. The golf training device of claim 2 wherein the joint and clamp are simultaneously locked through a single manually operated control.

4. The golf training device of claim 2 including separate, manually operated controls associated the locking joint and locking clamp, respectively.

5. The golf training device of claim 2, further including a physical stop associated with the locking joint enabling a user to more easily adjust the point to assume a preferred orientation.

6. The golf training device of claim 1, the proximal end of the member being padded to enhance comfort during use.

7. The golf training device of claim 6, the padding end resembling the handgrip end of a typical golf club.

* * * * *

UNITED STATES PATENT AND TRADEMARK OFFICE

CERTIFICATE OF CORRECTION

PATENT NO. : 5,520,392

DATED : May 28, 1996

INVENTOR(S) : Foresi et al

It is certified that error appears in the above-indentified patent and that said Letters Patent is hereby corrected as shown below:

Column 1, line 16: Replace "error U.S." with --error. U.S.--

Column 1, line 18: Replace "no" with --to--.

Column 1, line 46: After "degrees" insert --to--.

Column 2, line 2: Replace "mender" with --member--.

Column 2, line 25: Replace "hand" with --hands--.

Column 2, line 63: Replace "first, portion" with --first portion--.

Column 3, line 10: Replace "compressions type" with --compression-type--.

Column 3, line 47: Replace "tile" with --the--.

Column 3, line 49: Replace "tile" with --the--.

Column 4, line 34: Replace "mender" with --member--.

Column 4, line 65: Replace "off" with --of--.

Column 5, line 2: Replace "not:" with --not--.

Column 5, line 5: Replace "shsft" with --shaft--.

Column 5, line 7: Replace "embodimet" with --embodiment--.

Column 5, line 41: Replace "mender" with --member--.

UNITED STATES PATENT AND TRADEMARK OFFICE

CERTIFICATE OF CORRECTION

PATENT NO. : 5,520,392

DATED : May 28, 1996

INVENTOR(S) : Foresi et al

It is certified that error appears in the above-indentified patent and that said Letters Patent is hereby corrected as shown below:

Column 5, line 62: Replace "one" with --of--.

Column 6, line 12: Replace "possible," with --possible.--.

Column 6, line 25: After "removing" insert --it.--.

Column 6, line 29: After "like" insert --swing--.

Column 6, line 60: Replace "point" with --joint--.

Signed and Sealed this

Twenty-first Day of January, 1997

*Attest:*

Bruce Lehman

BRUCE LEHMAN

*Attesting Officer*

*Commissioner of Patents and Trademarks*